US008166662B2

(12) United States Patent
Williams

(10) Patent No.: US 8,166,662 B2
(45) Date of Patent: May 1, 2012

(54) ARCHERY SIGHT

(76) Inventor: Perry H. Williams, Camden, NY (US)

( * ) Notice: Subject to any disclaimer, the term of this patent is extended or adjusted under 35 U.S.C. 154(b) by 1 day.

(21) Appl. No.: 12/845,365

(22) Filed: Jul. 28, 2010

(65) Prior Publication Data

US 2011/0023311 A1 Feb. 3, 2011

Related U.S. Application Data

(60) Provisional application No. 61/271,977, filed on Jul. 29, 2009.

(51) Int. Cl.
*F41G 1/467* (2006.01)

(52) U.S. Cl. ..... 33/265; 124/87

(58) Field of Classification Search ..... 33/265, 33/334; 124/87, 88
See application file for complete search history.

(56) References Cited

U.S. PATENT DOCUMENTS

| | | | | |
|---|---|---|---|---|
| 2,559,927 A | | 7/1951 | Beloungy | |
| 3,289,300 A | * | 12/1966 | Jordan | 33/265 |
| 3,871,105 A | | 3/1975 | Brougham | |
| 4,162,579 A | | 7/1979 | James | |
| 4,215,484 A | | 8/1980 | Lauffenburger | |
| 4,669,194 A | | 6/1987 | Amacker | |
| 4,685,217 A | | 8/1987 | Shader | |
| 5,367,780 A | | 11/1994 | Savage | |
| 5,671,724 A | | 9/1997 | Priebe | |
| 5,802,726 A | | 9/1998 | Trosper, Jr. et al. | |
| 6,796,039 B2 | | 9/2004 | Walbrink | |
| 6,842,989 B1 | | 1/2005 | Wuthrich | |
| 7,331,112 B2 | | 2/2008 | Gibbs | |
| 7,461,460 B2 | * | 12/2008 | Priebe | 33/265 |
| 2008/0010841 A1 | * | 1/2008 | Gordon | 33/265 |
| 2008/0163503 A1 | * | 7/2008 | Priebe | 33/265 |
| 2008/0168671 A1 | * | 7/2008 | Rager | 33/265 |
| 2011/0072672 A1 | * | 3/2011 | Hoffman | 33/265 |

* cited by examiner

*Primary Examiner* — G. Bradley Bennett
(74) *Attorney, Agent, or Firm* — Harris Beach PLLC

(57) ABSTRACT

An archery sight for use with an archery bow is described that comprises multiple elements for two-point alignment, but wherein each of the points of the two-point alignment are positioned away from the archer's eyes at the full-draw or ready-to-shoot position. In one embodiment, the archery sight comprises an alignment element and one or more target elements, the position of which are set independently of the other target elements. An adjustment mechanism is coupled to each of the elements, thereby permitting movement such as vertical and horizontal movement of the elements relative to the archery bow.

20 Claims, 9 Drawing Sheets

ARCHERY SIGHT

CROSS-REFERENCE TO RELATED APPLICATIONS

This application claims the benefit of priority under 35 U.S.C. §119(e) from U.S. Provisional Patent Application Ser. No. 61/271,977, entitled "Peepless Archery Sight" and filed on Jul. 29, 2009. The content of this application is incorporated herein by reference in its entirety.

TECHNICAL FIELD

The subject matter of the present disclosure relates to an archery sight and, in one particular embodiment, to an archery sight configured for two-point alignment.

BACKGROUND

Conventional archery sights are typically mounted to an archery bow such as on the bow riser. These sights utilize target pins that are positioned forward of the bow riser when the sight is mounted to the archery bow. The target pins are vertically spaced from one another, with the position of each being individually set by the archer. These positions can correspond to a predetermined distance to the target. This type of archery sight uses a single point for shot alignment, wherein there is no additional alignment features found between the archer's eye and the target pin. However, because these archery sights utilize only one point for alignment, the archery sight does not produce shot alignment that is consistent from shot-to-shot. This lack of consistency reduces the accuracy of the archer's shot.

To remedy this deficiency, improvements in archery sights employ an aiming aid, such as a "peep sight," that is used in conjunction with the single-point sight discussed above. The "peep sight" is mounted to the bow string. And when implemented for aligning a shot, the archer looks through the "peep sight" at full draw, or ready-to-shoot position, to the target pin(s). However, for purposes of alignment and ultimately accuracy, the archer must align the center of the "peep sight," the target pin, and the target.

Although the "peep sight" provides a second point for alignment, this arrangement also has limitations. The "peep sight" may become twisted in the bow string. Such twisting may result in a view of the target pin that is limited or obstructed. Restrictions in the view of the target are likewise associated with the "peep sight" because of the construction of the "peep sight." Many "peep sights," for example, are constructed as a plastic ring that with a view area defined by its inside diameter, which is typically only about 3 mm to 6 mm in diameter. Moreover, because the "peep sight" is secured in the center of the bow string, at full draw the position of the "peep sight" is directly in front of the archer's eye. This position may further obstruct the archer's view of the target, regardless of the light conditions (e.g., full day light or low light conditions).

It would therefore be advantageous to improve the archery sights with limited visual obstructions, as well as with features that improve accuracy and alignment such as would improve the archer's ability to quickly align with moving targets in conditions such as low light and thick vegetation.

SUMMARY

Embodiments of the archery sight discussed below comprise multiple elements including an alignment element and a target element, each being located in a position that is away from the archer's eyes at the full-draw or ready-to-shoot position. This configuration provides a view to the target that is unobstructed by components of the archery sight. Moreover, by removing these potential impediments from proximate the archer's eye, configurations of the archery sight improve the archer's vision in low-light and thick vegetation conditions.

Each of the alignment element and target element is configured for horizontal adjustment and vertical adjustment, thus affording embodiments of the archery sight flexibility to vary the combinations and configurations of the elements. This flexibility is beneficial because the archery sight can be arranged for use with either of the archer's eyes. Whereas conventional sights necessitate the use of one eye, archery sights of the present disclosure have increased horizontal adjustment that permit the archer to adjust the sight for right-eye aiming or to adjust for left-eye aiming. Depending how the archer adjusts the embodiments of the archery sight, the archer can utilize either the dominate eye or the non-dominate eye.

Further discussion of these and other features is provided below in connection with one or more embodiments, examples of which may be described in the following:

In one embodiment, an archery sight comprises a first element and a second element spaced apart from the first element. The archery sight also comprises an adjustment device coupled to each of the first element and the second element and a leveling device. In one example of the archery sight the adjustment device is configured to move the first element independent of the second element. In another example of the archery sight the first element, the second element, and the leveling device form a target view for viewing a target.

In another embodiment, a device for aligning an archery bow with a target. The device comprises a frame having a first end and a second end, an alignment pin proximate the first end, and a plurality of target pins spaced apart from the alignment pin and proximate the second end. The device also comprises a horizontal adjustment device coupled to each of the alignment pin and the target pins and a vertical adjustment device coupled to the horizontal adjustment device. The device further comprises a leveling device. In one example of the device, the plurality of target pins comprises a pre-selected top target pin and a distance pin. In another example of the device, the alignment pin, the plurality of target pins, and the leveling device form a target view. In yet another example of the device the distance pin is displaced vertically from the alignment pin and the pre-selected top target pin in the target view.

In yet another embodiment, a sight for aligning an archery bow with a target. The sight comprises a target reference, an alignment reference spaced apart from the target reference, a frame supporting each of the alignment reference and the target reference, and a leveling device coupled to the frame. In one example of the sight, the target reference and the alignment reference comprise at least one element. In another example of the sight, the elements and the leveling device form a target view for viewing a target.

BRIEF DESCRIPTION OF THE DRAWINGS

So that the manner in which the above recited concepts of the present disclosure may be understood in detail, a more particular description is provided by reference to the embodiments, which are illustrated in the accompanying drawings. It is to be noted, however, that the appended drawings illustrate only typical embodiments and are therefore not to be considered limiting of its scope, for the concepts of the present disclosure may admit to other equally effective embodiments. Moreover, the drawings are not necessarily to scale, emphasis generally being placed upon illustrating the principles of certain embodiments.

Thus, for further understanding of these concepts and embodiments, reference may be made to the following detailed description, read in connection with the drawings in which.

DETAILED DESCRIPTION

Figure 1:
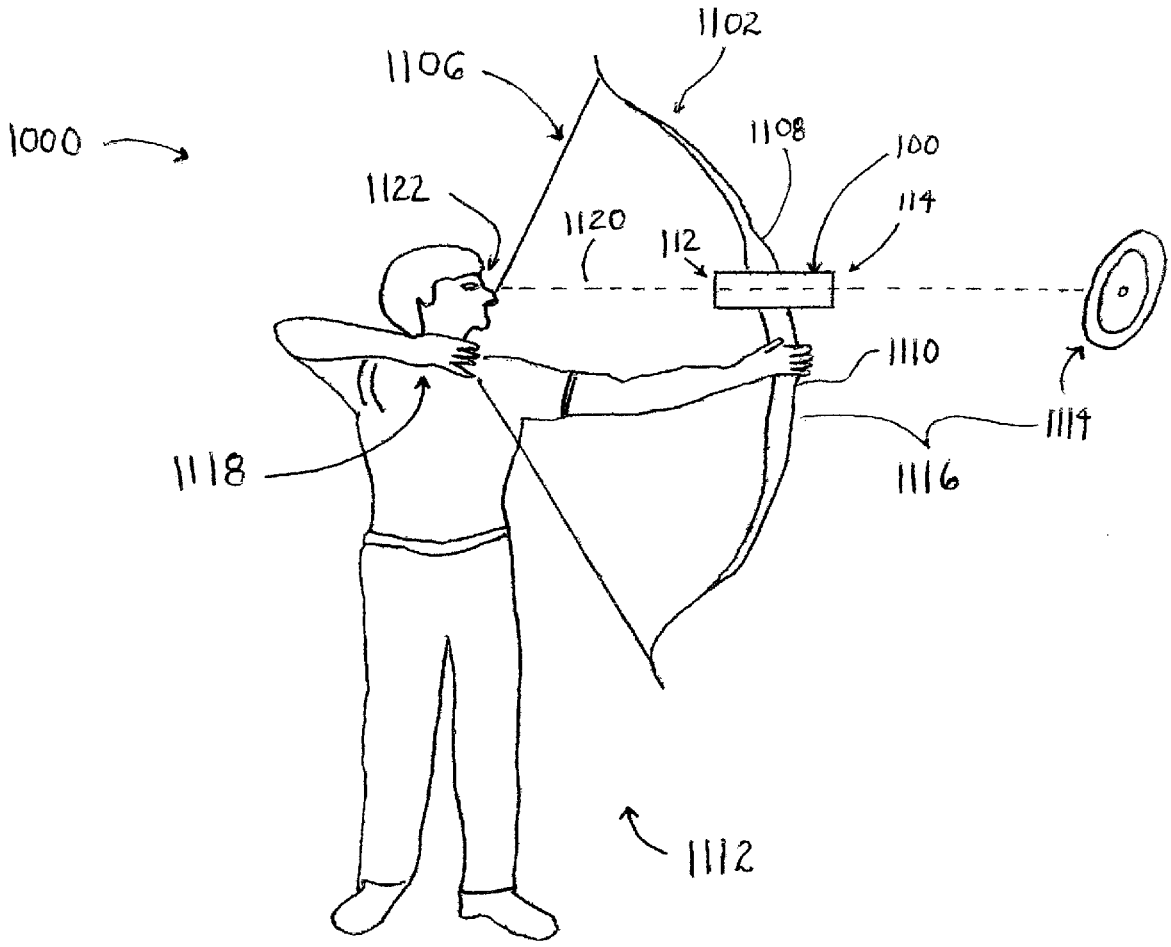
FIG. 1 is a side view of an archer with an archery bow equipped with an exemplary embodiment of an archery sight.
Figure 2:
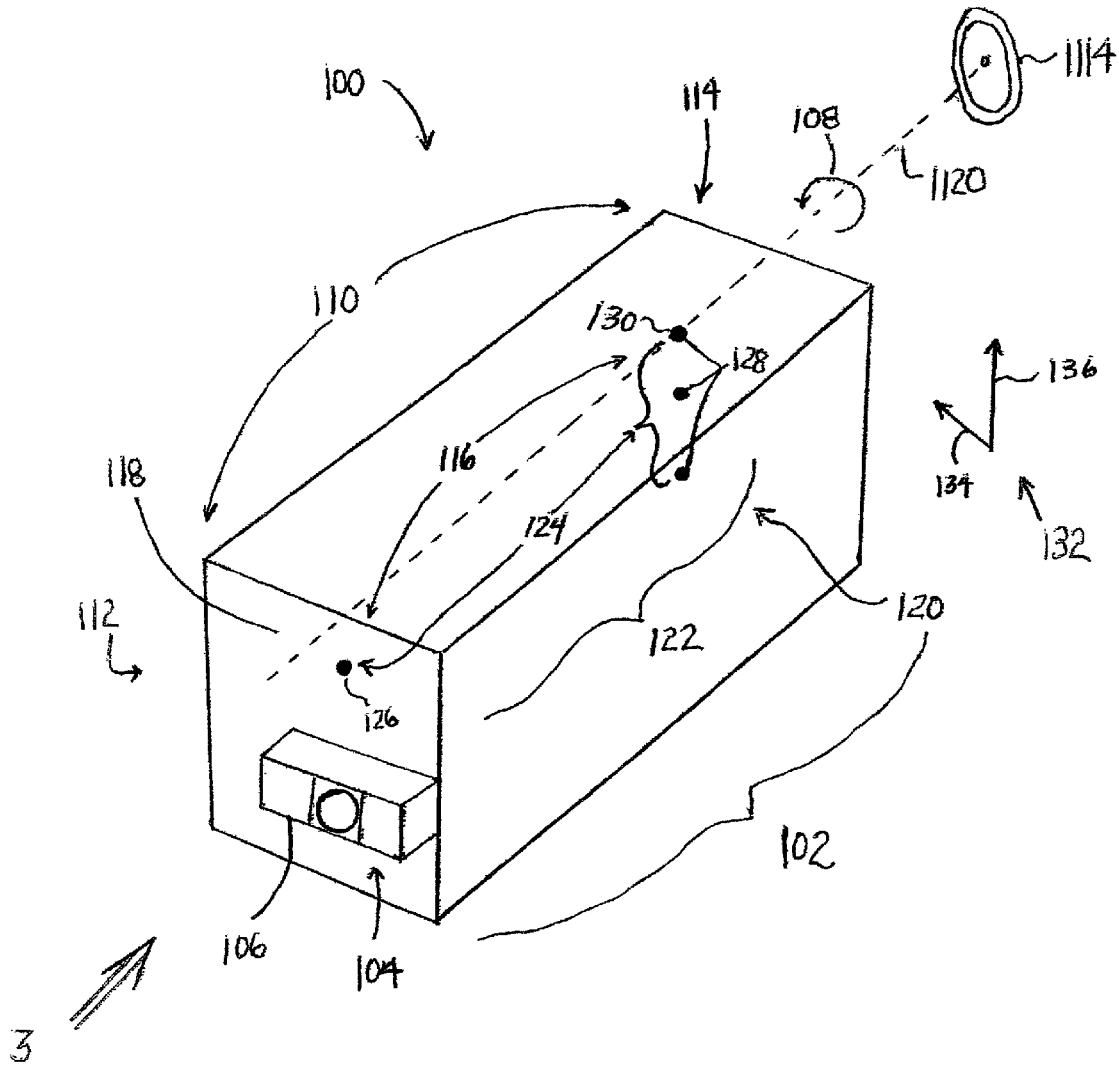
FIG. 2 is a schematic diagram of a perspective view of the archery sight of FIG. 1.
Figure 3:
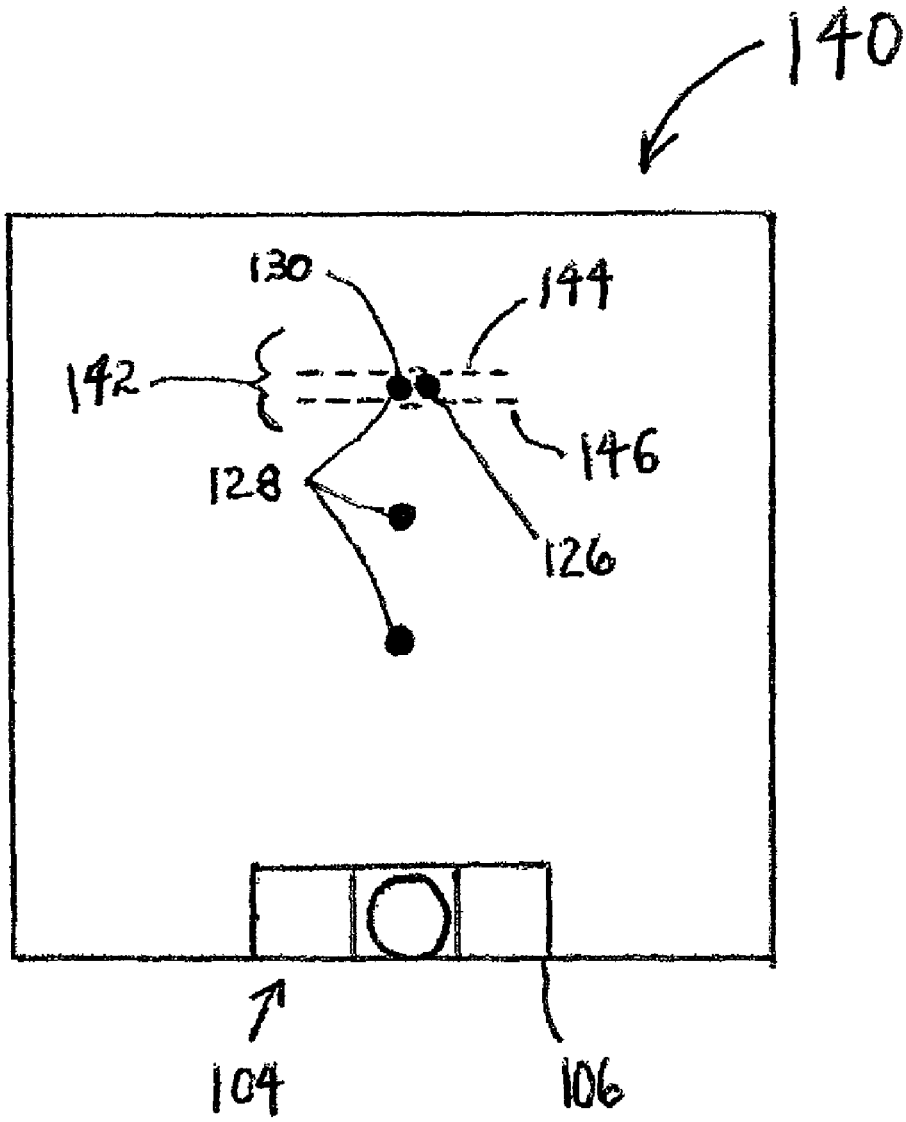
FIG. 3 is a schematic diagram of an archer's view of the archer sight of FIGS. 1 and 2.
Figure 4:
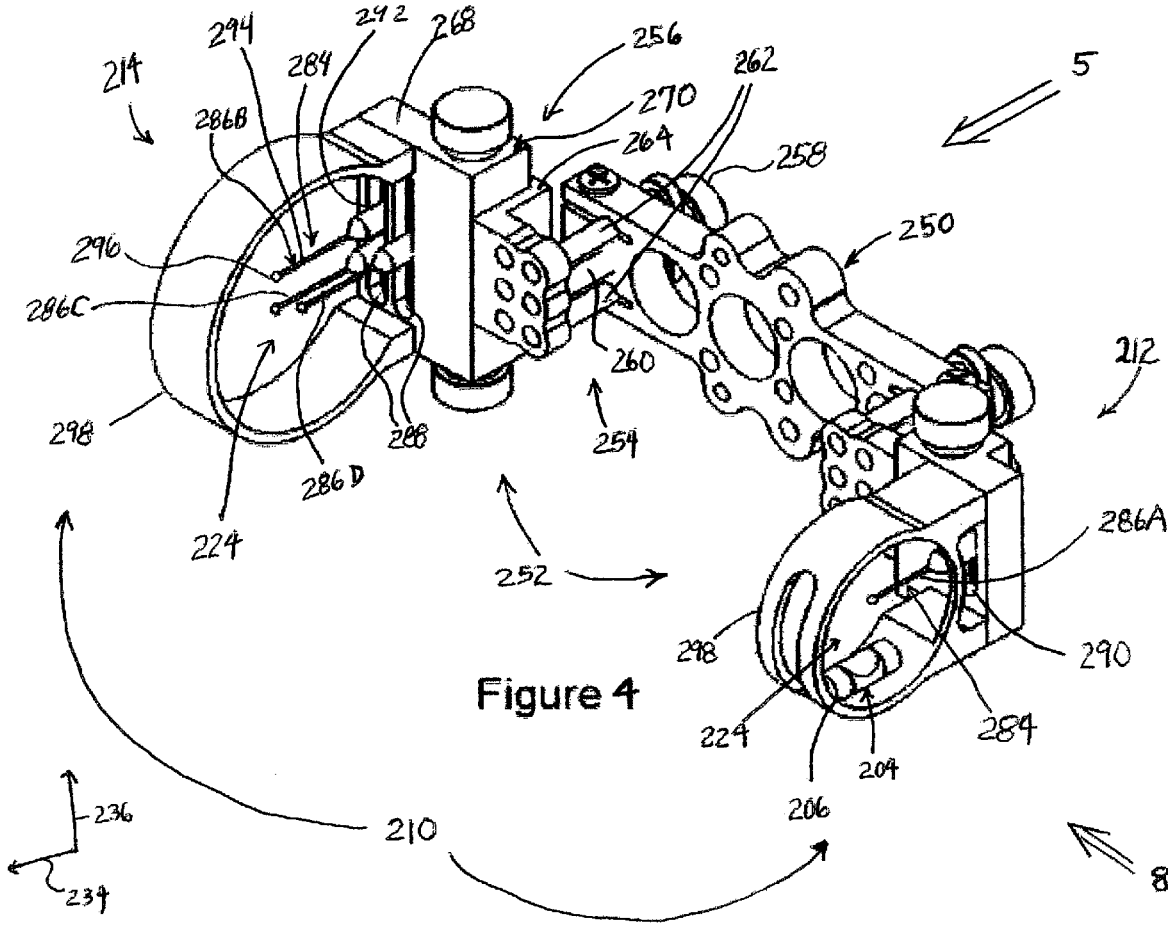
FIG. 4 is a side perspective view of another exemplary embodiment of an archery sight.
Figure 5:
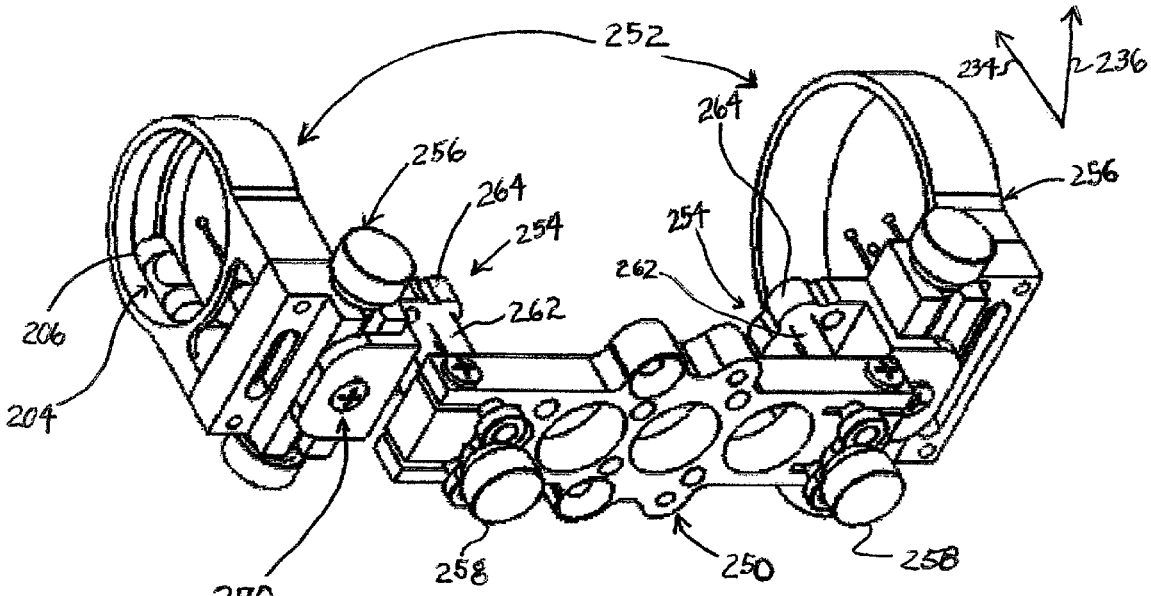
FIG. 5 is a side perspective view of the archery sight of FIG. 4.
Figure 6:
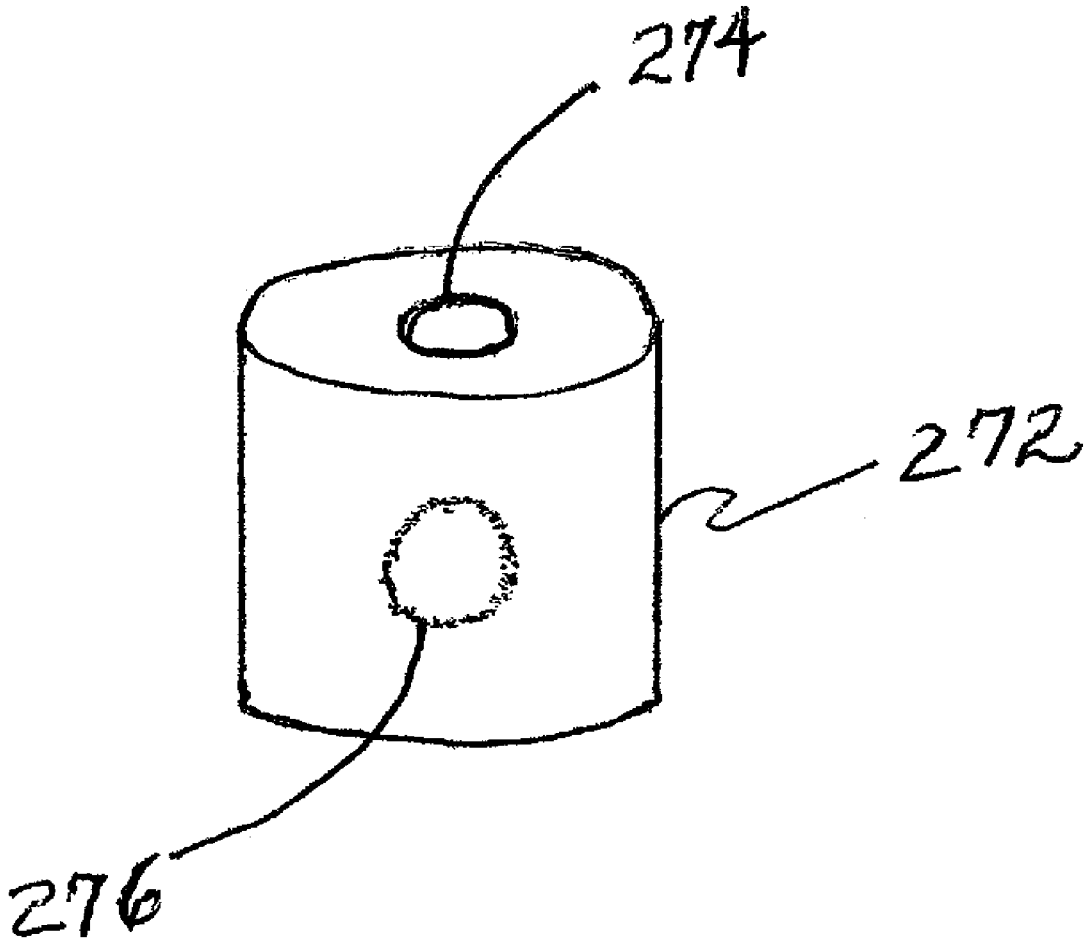
FIG. 6 is a side perspective view of a component for use in an embodiment of an archery sight such as the archery sights of FIGS. 1-5.
Figure 7:
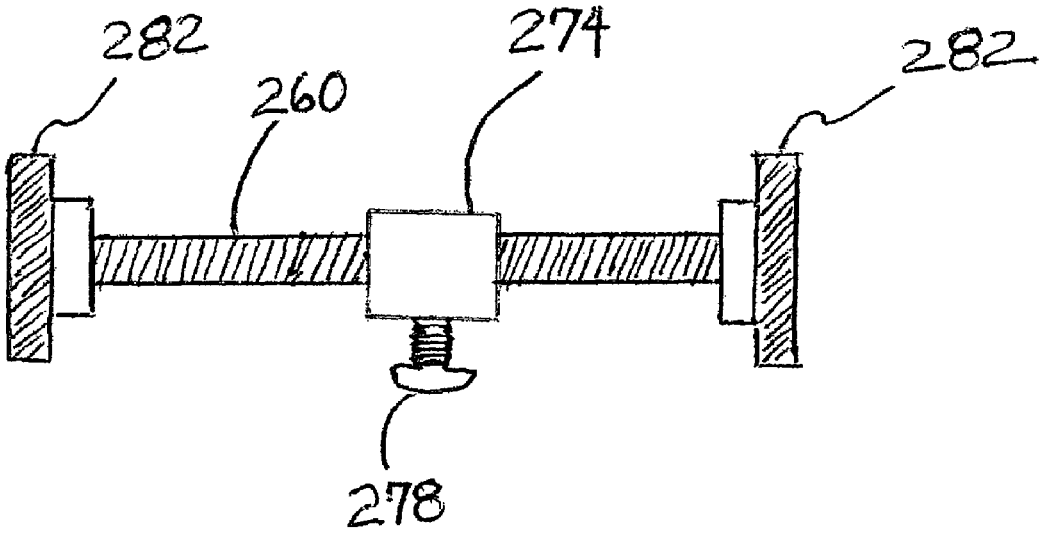
FIG. 7 is a side view of another component for use in an embodiment of an archery sight such as the archery sights of FIGS. 1-5.

Referring first to FIGS. 1-3, there is depicted an exemplary embodiment of an archery sight 100 implemented for use by an archer 1000 on a bow 1102 such as a compound hunting bow. The bow 1102 includes a bow string 1106 and a bow riser 1108, on which is disposed a handle 1110. Typical configurations of the bow riser 1108 include pre-formed mounting points (not shown) such as mounting holes for securing the archery sight 100 proximate the handle 1110. The archer 1000 is illustrated in a shooting form 1112, aiming at a target 1114 that is located remote from the archer 1000 as measured by a target distance 1116. In one example, the shooting form 1112 is defined by a drawn position 1118 for the bow string 1106 such as the full-drawn position or ready-to-shoot position illustrated in FIG. 1. The shooting form 1112 is also defined by a sight line 1120 that is formed from the archer 1000 (e.g., at an eye 1122) to the target 1114 via the archery sight 100, details of which follow below.

In one embodiment, the archery sight 100 comprises an alignment device 102 and a leveling device 104 such as a bubble level 106. The leveling device 104 facilitates proper alignment of the bow 1102 by minimizing an angular rotation 108 (or "roll") about the sight line 1120. The alignment device 102 comprises ends 110 and more particularly an alignment end 112 that is closest to the archer 1000 and a target end 114 that is closest to the target 1114. Each of the ends 110 comprises one or more references 116 such as an alignment or first reference 118 and a target or second reference 120, which is spaced apart from the alignment reference 118 by a separation distance 122.

Elements 124 are implemented at each of the references 116 to facilitate alignment of the bow 1102 and the target 1114. The elements 124 include an alignment element 126, which is located proximate the alignment end 112, and one or more target elements 128 near the target end 114. The target elements 128 can include a pre-selected top target element 130, which is used in combination with the alignment element 126 to define the sight line 1120. In one embodiment, the elements 124 are configured for adjustment 132, and preferably the elements 124 are independently adjustable to improve operation and implementation of the archery sight 100 as contemplated herein. The adjustment 132 includes horizontal adjustment 134 and vertical adjustment 136, both providing movement of the elements 124 relative to, e.g., the mounting position of the archery sight 100 on the bow riser 1108. When multiple of the target elements 128 are provided, the adjustment 132 facilitates vertical spacing of each of the target elements 128 from one another. Designated by the numeral 136, this spacing is based in one example on the value for the target distance 1116.

As best depicted in FIG. 3, when the archer 1000 is in, e.g., the shooting form 1112, implementation of the archery sight 100 provides a target view 138. The target view 138 comprises a reference view 140 in which the alignment element 126 is positioned in adjacent relationship to the pre-selected top target element 130. In one example, proper alignment with the target 1114 is indicated by alignment of the outer peripheral boundaries of the alignment element 126 and the pre-selected top target element 130. This indication is depicted in the present example by way of boundaries 142 such as the upper boundary 144 and the lower boundary 146. It should be recognized, however, that the boundaries 142 are typically imaginary. That is the boundaries 142 are illustrated in the example of FIG. 3 to observe and clarify the boundary-to-boundary alignment of the alignment element 126 and the pre-selected top target element 130. Moreover, whereas the focus herein is on the outer peripheral boundary of these elements, it is likewise contemplated that other features can indicate alignment of the alignment element 126 and the pre-selected top target element 130. By way of example, but not limitation, these other features can include points on the elements such as the center, as well as notches, markings, and other demarcations that are provided on one or more of the alignment element 126, the target elements 128, and the pre-selected top target element 130. Sources for such demarcations can include manufacturing process, assembly steps, and implementation by the end user (e.g., the archer 1000).

Elements 124 can include objects such as spherical balls that are consistent in form to the circular profile of the alignment element 126 and the target elements 128 illustrated in FIG. 3 (and generally in FIG. 2). Of course other objects with other profiles can be used, including square, rectangular, and elliptical profiles, as each can be configured for purposes of alignment as required herein. Objects can be selected that conform to these other profiles. In one embodiment, the profile of the target elements 128 is larger than the profile of the alignment element 126, thus facilitating the appearance to the archer 1000 that the elements 124 are of the same size in the reference view 140. By way of example, the alignment element 126 may comprise a spherical ball that has a diameter of about 0.5 mm and the target elements 128 may comprise a spherical ball that has a diameter of about 0.7 mm The dimensions for each of the elements 124 can likewise depend on values for the separation distance 122, i.e., the distance between the alignment element 126 and the target elements 128. These values can vary, with embodiments of the archery sight 100 being configured so that the separation distance 122 is from about 50 mm to about 405 mm, and in one configuration the separation distance 122 is from about 150 mm to about 165 mm.

Each of the alignment element 126 and target elements 128 are located proximate the bow riser 1102 when the archery sight 100 is mounted to the bow 1102. While not depicted in the present example of FIG. 1-3, the archery sight 100 can comprise mechanical components such as a frame or other constructive elements that are used to secure the elements 124 to one another and to the bow riser 1108. In one example, one or more of the target elements 128 are located forward, or in front of, the bow riser 1108. The alignment element 126 may be located behind the bow riser 1108, wherein the alignment element 126 is closer to the archer 1000 than the target elements 128.

For additional discussion of the concepts of the present disclosure reference can now be had to FIGS. 4-8, which depicts in varying views another exemplary embodiment of an archery sight 200. Like numerals are used to identify like components as between FIGS. 1-3 and 4-8, but the numerals are increased by 100 (e.g., 100 is 200 in FIGS. 4-8). For example, the archery sight 200 comprises a leveling device 204 such as a bubble level 206, ends 210 including an alignment end 212 and a target end 214, and elements 224 including an alignment element 226 and target elements 228. The archery sight 200 is also configured for horizontal adjustment 234 and vertical adjustment 236. However, it is contemplated that although some features discussed in connection with the archery sight 100 are not labeled or described in connection with the archery sight 200, these features are likewise applicable and can implemented within the scope and spirit of the present disclosure.

The archery sight 200 also comprises a frame 250 that can be coupled to, e.g., the bow riser 1108 (FIG. 1). An adjustment device 252 is secured to the frame 250 and configured for movement of each of the alignment element 226 and the target elements 228. In one embodiment, located proximate each end 210 (e.g., the alignment end 212 and the target end 214) of the archery site 200, the adjustment device 252 includes a horizontal adjustment mechanism 254 and a vertical adjustment mechanism 256 (also referred to hereinbelow as "the adjustment mechanisms"). In one embodiment, the adjustment mechanisms can move independently thereby moving one or more of the elements 224 independent of the other elements 224. The adjustment mechanisms can comprise various configurations of elements that effectuate movement of, e.g., the alignment element 226 and the target elements 228. Such elements can for example provide translation, rotation, and other operative movements that change the position of the elements 224. Selection and combination of these elements is made to accommodate fine adjustment of the position such as on the order of at least about ±25 mm, with one particular combination providing from about 12 mm to about 50 mm of adjustment of one or more of the alignment element 226 and the target elements 228.

One configuration is provided in the present example in which the adjustment mechanisms of each end 210 are configured alike. Elements for use in the adjustment mechanisms include various combinations of threaded fasteners, threaded rods, pins, plates, and the like. In one embodiment, the horizontal adjustment mechanism 254 comprises a thumb wheel 258, a threaded rod 260 coupled to the thumb wheel 258 and extending through the frame 250, and one or more guide pins 262. A bracket 264 is secured to the threaded rod 260 and the guide pins 262. The bracket 264 is configured to receive the vertical adjustment mechanism 256 thereon such as by way of one or more fasteners 266. In one embodiment, the amount of adjustment afforded by way of vertical adjustment is at least ±25 mm, and in one particular construction the alignment element 226 can be adjusted at least about ±30 mm and the target element 228 can be adjusted at least about ±45 mm.

The vertical adjustment mechanism 256 comprises a block 268 with a bore 270 that extends vertically therethrough. Inside of the bore 270 is located a sleeve 272, clearly depicted in FIGS. 6 and 7 with a through bore 274 and a cross bore 276. The through bore 274 is aligned with the bore 270 when the sleeve 272 is assembled into the block 268. The cross bore 276 is configured to receive a fastener 278. A threaded rod 280 is disposed in the bore 270 and extends through the through bore 274. Threads (not shown) complementary to those disposed on the threaded rod 260 are likewise found inside the through bore 274. Knobs 282 are coupled to opposing positions of the threaded rod 260, thus effectuating the vertical translation contemplated herein. The vertical translation can be at least about ±30 mm for the alignment element 226 and the target element 228. In one example, tightening of the fastener 278 locks the vertical movement of the block 268.

The elements 224 of the archery site 200 are configured as one or more elongated pins 284 including an alignment pin 286A, a pre-selected top target pin 286B, and one or more other target pins 286C and 286D. In one embodiment, the elongated pins 284 are coupled to each block 268 via slots 288 and 290. Each of the elongated pins 284 comprises a base portion 292, an elongated body portion 294, and an end portion 296. A guard 298 is attached to the block 268. The guard 298 protects the elongated pins 284 from damage such as can occur by way of trees, brush, and similar impediments that are experienced during, e.g., hunting and related outdoor sports.

Appropriate fasteners are contemplated for use to secure the elongated pins 284 to the block 268. These fasteners can include threaded fasteners, e.g., screws, nuts, bolts, and the like. In one example, the base portion 292 is configured to fit into and engage at least a portion of the slots 288 and 290. When implemented in combination with the fastener, each of the elongated pins 284 can be adjusted independently within the slot, thereby permitting changes to the position, e.g., the vertical position, of the elongated pins 284 within the slot and relative to other of the elongated pins 284 that are implemented in the archery site 200. This relative movement is beneficial to the archer (e.g., the archer 1000 of FIG. 1) for setting the initial position of one or more of the alignment pin 286A and the target pins 286B-D. This initial position can reflect a target distance (e.g., the target distance 1116 (FIG. 1)) to the target, wherein in one construction the position of each of the target pins 286B-D corresponds to a different value for the target distance. These values can include, for example, values of at least about 15 m for a pre-selected top target pin 286B, from about 18 m to about 32 m for the other target pins 286C and 286D, and overall from about 1 m to about 90 m.

The elongated pins 284 may comprise metals, plastics, composites and combinations thereof, and in one construction fiber-optic material is used to form at least a portion of the elongated pins 284. Construction of the elongated pins 284 may include applying coatings such as colored paint, light absorbing phosphorescent materials such as "glow in the dark" phosphoric materials, "day glow" paint, or other materials with improved visibility in low-light conditions. As discussed above, the end portion 296 may be formed into a spherical shape, although other shapes are likewise contemplated to fall with the scope and spirit of the present disclosure.

Construction of the elements (including the elongated pins 284 where applicable) used in the archery sight 200 can comprise one or more of aluminum (e.g., 6061 T-6 Aluminum), steel and stainless steel, plastics, composites, and any combinations and derivations thereof. One or more of the pieces parts discussed above can be manufactured using techniques and processes consistent with the nature, accuracy, and tolerances of the configurations proposed herein. Machining, turning, extruding, and casting are all suitable operations for manipulating the materials of construction. Moreover, one or more of the elements may be coated to avoid corrosion and degradation, as well as for aesthetic purposes. Paints and surface coatings such as powder coatings, hard coatings (e.g., anodized coatings) and electroplating can be utilized for this purpose.

Figure 8:
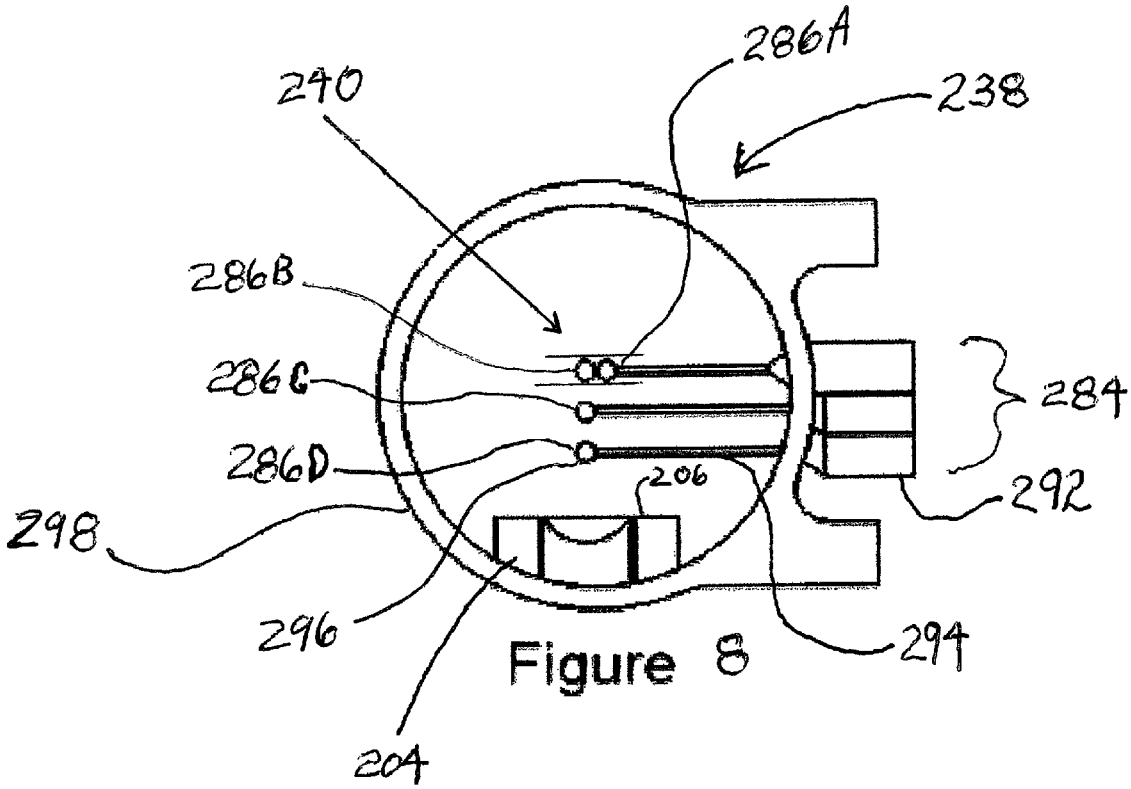
FIG. 8 is an archer's view of the archery sight of FIGS. 4 and 5.

Referring now to FIG. 8, there is depicted an example of a target view 238 that corresponds to the construction and embodiments of the archery sight 200. The target view 238 comprises a reference view 240, defined in this example by way of the alignment pin 286A and the target pins 286B-D. In one embodiment, the alignment pin 286A and the target pin 286B are positioned on a horizontal plane, extending imaginarily from the archer's eye to the target. This configuration affords the archer a view of a target that is unobstructed. The alignment pin 286A is positioned rear of the bow riser and is aligned with the target pin 286B, which is positioned forward of the bow riser and which is pre-selected from one of the target pin 286B-D.

The orientation of the alignment pin 286A and the target pin 286B can be used by the archer to indicate misalignment of the shot if the reference view 240 is not seen by the archer while in the shooting form and aiming and releasing the arrow to flight. Proper alignment of the target pin 286B in relation to the alignment pin 286A reduces the likelihood of error and, in particular, instructs the archer as to proper, consistent, and repeatable shooting form. In one example, proper alignment is indicated in the reference view 240 by the target pin 286B being visible and adjacent (e.g., to the left) of the alignment pin 286A for archers that are right-handed.

Figure 9:
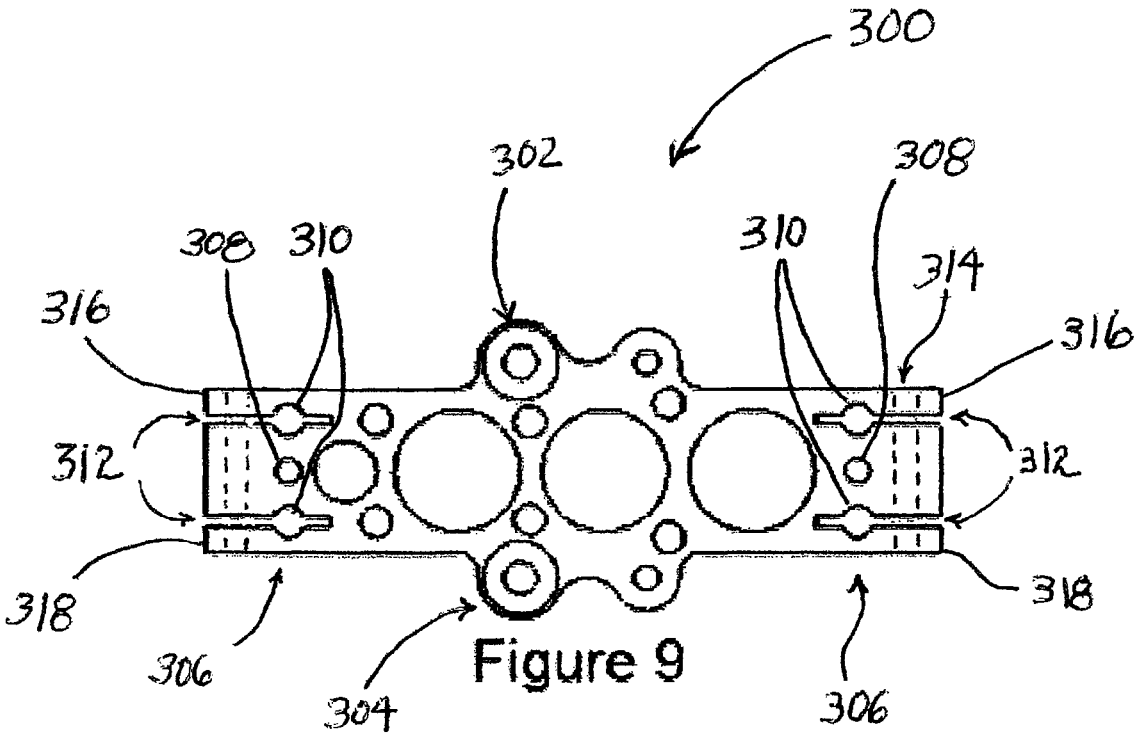
FIG. 9 is a plan view of a component for use in an embodiment of an archery sight such as the archery sights of FIGS. 1-5.

As particularly illustrated in FIG. 9, there is provided in plan view an exemplary construction of a frame 300, which can be used as the frame 250 discussed above. In one embodiment, the construction of the frame 300 includes holes 302 and 304 for accepting common threaded screws (e.g., 10-24 threads and about 15 mm length). These holes and fasteners are used to mount the frame 300 to the bow riser. The frame 300 can also include holes for mounting the horizontal adjustment mechanism 254, generally identify by 306. In one embodiment, the holes 306 include a central hole 308 and peripheral holes 310. The holes 306 are generally perpendicular to the bow riser when the archery site 200 is mounted thereon. In one example, the central hole 308 receives the threaded rod 260 and the peripheral holes 310 receive the guide pins 264. The holes 306 can be in one example sized for slight slip and slight press fits with, e.g. the threaded rod 260 and the guide pins 264.

Optionally, the frame 300 includes relief cuts 312 that extend from the outer periphery of the frame 300 towards the holes 306. In one example, and as illustrated in the embodiment of FIG. 9, the relief cuts 312 extend past the holes 306. Material of the frame 300 is removed to form the relief cuts 312, with gaps formed having a dimension of from about 1 mm to about 3 mm, with the gap in one particular construction being about 1.5 mm Near the ends of the frame 300 are located a bore 314, extending vertically through the relief cuts 312. In one example, the interior surface of the bore (not shown) is threaded, and more particular to one construction of the frame 300 the bore 314 includes female threads that are incorporated and positioned at one of the outer most portions of the bore 314 such as the outer portions 316 and 318 in FIG. 9. The bore 314 may receive a threaded fastener, which extends through the bore 314, so that tightening of the threaded fastener causes the outer portions 316 and 318 to compress such as onto the guide pins 264. This compression is useful to stop horizontal movement of the horizontal adjustment mechanism 254. Likewise loosening of the threaded fastener can allow movement of the horizontal adjustment mechanism 254.

With continued reference to FIGS. 4-9, a discussion of one implementation of embodiments of the archery sight 200 (hereinafter, "the archery sight") follows immediately below. In one embodiment, the archery site is mounted to the bow riser using pre-formed holes found on conventional archery bows. The pre-selected top target pin (e.g., the pre-selected top target pin 286B) is adjusted so that the location of the pre-selected top target pin in the target view permits the archer to consistently hit the target at a target distance (e.g., the target distance 1116) of about 18 m. In one embodiment, the alignment pin (e.g., the alignment pin 286A) is thereafter adjusted so that the location of the alignment pin provides to the archer the reference view (e.g., the reference view 240) and more particularly where the end of the pre-selected top target pin is aligned with and adjacent the end of the alignment pin as contemplated herein. This configuration of the ends is also called a "dot-to-dot" view. In one example, the reference view is likewise defined by way of the leveling device (e.g., the leveling device 204), wherein for example the archer sees both the bubble level (e.g., the bubble level 206) centered and the dot-to-dot view.

In one embodiment, the archer can perform additional adjustments using the adjustment device (e.g., the adjustment device 252). These additional adjustments further locate the alignment pin and the pre-selected top target pin so as that the archer is consistently hitting the target at about 18 m. The archer is typically in the shooting form (e.g., the shooting form 1112) wherein the bow string (e.g., the bow string 1106) is in the full-draw position and the archer is looking at the target via the target view.

In one embodiment, the target pins (e.g., the target pins 286C and 286D) other than the pre-selected top target pins can be adjusted for values of the target distance that are different from the pre-selected top target pin. In one example, these values can be greater than 18 m, with one settings of the target pins configured for target distances of from about 18 m to about 32 m. For each of these settings, the archer has the bow string at full-draw and is looking at the target via the target view.

In one embodiment, the archer looks at the target via the target view, centers the bubble of the bubble level, and ensures the dot-to-dot view is visible with the end of the alignment pin on the target. If the target is located within, e.g., 18 m, then the archer can release a projectile (e.g., an arrow) using the alignment of the pre-selected top target pin on the target. For targets located at distances greater than, e.g., 18 m, the archer can raise the target view so as to align one of the other target pins on the target, while maintaining the dot-to-dot view of the pre-selected top target pin and the alignment pin with the centered bubble level. The target pin that is selected can, in one example, correspond to the value of the target distance assigned to that target pin during implementation of the archery sight on the bow as discussed in detail above.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified.

That is, numerical values may include the actual value that is expressly stated, as well as other values that are, or may be, the decimal, fractional, or other multiple of the actual value indicated, and/or described in the disclosure.

While the present disclosure has shown and described details of exemplary embodiments, it will be understood by one skilled in the art that various changes in detail may be effected therein without departing from the spirit and scope of the disclosure as defined by claims that may be supported by the written description and drawings. Further, where these exemplary embodiments (and other related derivations) are described with reference to a certain number of elements it will be understood that other exemplary embodiments may be practiced utilizing either less than or more than the certain number of elements.

What is claimed is:

1. An archery sight, comprising:

a) a first element;

b) a second element spaced apart from said first element;

c) an adjustment device coupled to each of said first element and said second element by a sight frame; and d) a leveling device, wherein said adjustment device is configured to move said first element independent of said second element, wherein said adjustment device is configured to change the horizontal and vertical position of each of said first element and said second element, and wherein said first element, said second element, and said leveling device form a target view for viewing a target.

2. An archery sight according to claim 1 wherein said leveling device comprises a bubble level proximate one of said first element and said second element.

3. An archery sight according to claim 1 further comprising a third element displaced vertically from said first element and said second element in the target view.

4. An archery sight according to claim 3 wherein said third element is located proximate said second element.

5. An archery sight according to claim 1 wherein said first element and said second element are configured to move independently of said sight frame.

6. An archery sight according to claim 1 wherein a first end portion of said first element is smaller than a second end portion of said second element, and wherein said first end portion of said first element and said second end portion of said second element appear the same size in the target view at full-draw and ready-to-shoot position of said bow.

7. An archery sight according to claim 1 wherein each of said first element and said second element comprises an elongated body and an end portion disposed on said elongated body, and wherein said elongated body is secured to said adjustment device.

8. An archery sight according to claim 7 wherein an end portion of said first element is offset from an end portion of said second element in said target view.

9. An archery sight according to claim 8 wherein said end portion of said first element is horizontally adjacent said end portion of said second element.

10. A device for aligning an archery bow with a target, said device comprising:

a) a frame having a first end and a second end;

b) an alignment pin proximate said first end;

c) a plurality of target pins spaced apart from said alignment pin and proximate said second end;

d) a horizontal adjustment device coupled to each of said alignment pin and said target pins;

e) a vertical adjustment device coupled to said horizontal adjustment device; and e) a leveling device, wherein said plurality of target pins comprises a pre-selected top target pin and a distance pins, wherein said alignment pin, said plurality of target pins, and said leveling device form a target view, and wherein said distance pins are displaced vertically from said alignment pin and said preselected top target pin in said target view.

11. A device according to claim 10 wherein said distance pin is configured for movement independent of said preselected top target pin.

12. A device according to claim 10 wherein said alignment pin and said plurality of target pins comprise a base portion coupled to said vertical adjustment, an elongated body portion extending from said base portion and an end portion disposed on said elongated body.

13. A device according to claim 12, wherein said end portion of said alignment pin has a diameter that is smaller than said end portion of said pre-selected top target pin, and wherein said end portion of said alignment pin and said end portion of said pre-selected top target pin appear the same size in said target view at full-draw and ready-to-shoot position of said bow.

14. A device according to claim 10, wherein said leveling device comprises a bubble level.

15. A sight for aligning an archery bow with a target, comprising:

a) a target reference;

b) an alignment reference spaced apart from said target reference;

c) a frame supporting each of the said alignment reference and said target reference;

d) a leveling device coupled to said frame, e) a horizontal adjustment mechanism secured to said frame; and f) a vertical adjustment mechanism secured to said horizontal adjustment mechanism, wherein said target reference and the said alignment reference comprise at least one element, wherein said elements and said leveling device form a target view for viewing said target, and wherein said horizontal adjustment mechanism and said vertical adjustment mechanism can change the positions of said elements independently.

16. A sight according to claim 15 wherein said elements comprise a first element proximate said alignment reference and a second element proximate said target reference, and wherein said first element and said second element are adjacent in said target view.

17. A sight according to claim 16 wherein said elements comprise third element elements vertically displaced relative to said first element and said second element in said target view.

18. A sight according to claim 15 wherein each of said elements is moveable with respect to said frame.

19. An archery sight according to claim 1 wherein said adjustment device has an adjustment range in said horizontal direction of between about zero and about 50 mm.

20. An archery sight in accordance with claim 19 further comprising a bow string wherein said archery sight is capable of adjustment such that an archer can aim said archery sight with his or her right or left eye regardless of which hand said archer uses to pull said bow string to a full draw ready-to-shoot position.

* * * * *

UNITED STATES PATENT AND TRADEMARK OFFICE

CERTIFICATE OF CORRECTION

PATENT NO. : 8,166,662 B2
APPLICATION NO. : 12/845365
DATED : May 1, 2012
INVENTOR(S) : Perry H. Williams It is certified that error appears in the above-identified patent and that said Letters Patent is hereby corrected as shown below:

Col. 10, Claim 17, Line 51 delete the word "element"

Signed and Sealed this
Twenty-sixth Day of June, 2012

David J. Kappos

David J. Kappos
*Director of the United States Patent and Trademark Office*